US007010892B2

(12) United States Patent
Tonkin

(10) Patent No.: US 7,010,892 B2
(45) **Date of Patent: *Mar. 14, 2006**

(54) COUNTER TOP TRIM MOLDING

(76) Inventor: Jason Tonkin, 3791 Vista Ter., Harrisburg, PA (US) 17111

( * ) Notice: Subject to any disclaimer, the term of this patent is extended or adjusted under 35 U.S.C. 154(b) by 0 days.

This patent is subject to a terminal disclaimer.

(21) Appl. No.: 10/915,836

(22) Filed: Aug. 11, 2004

(65) Prior Publication Data

US 2005/0011160 A1 Jan. 20, 2005

Related U.S. Application Data

(63) Continuation of application No. 10/190,388, filed on Jul. 3, 2002, now Pat. No. 6,865,854.

(51) Int. Cl.
*E04B 2/00* (2006.01)

(52) U.S. Cl. ..... 52/287.1; 52/716.1; 52/273; 52/782.22; 52/716.3; 52/717.04

(58) Field of Classification Search ..... 52/287.1, 52/716.1, 273, 782.22, 716.3, 717.04, 782.1, 52/716.2, 716.4, 717.05
See application file for complete search history.

(56) References Cited

U.S. PATENT DOCUMENTS

| | | | | |
|---|---|---|---|---|
| 2,143,034 A | | 1/1939 | Sakier | |
| 2,303,864 A | * | 12/1942 | Reasor | 52/716.2 |
| 2,570,850 A | | 10/1951 | Pearson | |
| 2,785,937 A | | 3/1957 | Murray | |
| 2,847,263 A | | 8/1958 | Osborne | |
| 2,895,778 A | * | 7/1959 | Lieber | 108/27 |
| 2,980,477 A | | 4/1961 | Hansen | |
| 3,077,012 A | | 2/1963 | Speraw | |
| 3,475,871 A | | 11/1969 | Saunders et al. | |
| 3,604,169 A | | 9/1971 | Smith | |
| 3,606,508 A | * | 9/1971 | Burnes | 312/140.3 |
| 4,368,225 A | | 1/1983 | Nussbaum | |
| 4,520,605 A | | 6/1985 | Budd | |
| 4,601,149 A | | 7/1986 | Dokan | |
| 4,760,681 A | | 8/1988 | Harrison | |
| 4,829,730 A | | 5/1989 | Zeilinger | |
| 4,998,817 A | | 3/1991 | Gaiser et al. | |
| 5,212,923 A | | 5/1993 | Pelosi et al. | |
| 5,289,663 A | | 3/1994 | Schluter | |
| 5,310,435 A | | 5/1994 | Kelly | |
| 5,509,634 A | | 4/1996 | Gebka et al. | |
| 5,553,431 A | | 9/1996 | Pelosi, Jr. et al. | |
| 6,085,027 A | | 7/2000 | Sexton | |
| 6,183,585 B1 | | 2/2001 | Kelley | |
| 6,186,605 B1 | | 2/2001 | Nelson | |
| 6,300,501 B1 | | 10/2001 | Dobrusin et al. | |
| 6,309,036 B1 | * | 10/2001 | Ancel | 312/140.4 |
| 6,343,454 B1 | | 2/2002 | Fisher | |

* cited by examiner

*Primary Examiner*—Daniel P. Stodola
*Assistant Examiner*—Nahid Amirii
(74) *Attorney, Agent, or Firm*—McNees Wallace & Nurick LLC

(57) ABSTRACT

A non-deformable laminated trim molding is provided to form watertight sealing between laminated panel members such as a counter top and a wall. The trim molding is laminated prior to installation so that the color of the laminated trim molding is related to the color of the laminated counter top. The trim molding includes a part to fit between panel members such as between a counter top and a wall or between a counter top and a back splash. A sealant layer between the laminated panel member and the laminated trim molding prevents water or other liquids from penetrating through to the substrate of the counter top, which is usually wood.

18 Claims, 5 Drawing Sheets

COUNTER TOP TRIM MOLDING

CROSS-REFERENCE TO RELATED APPLICATIONS

This application is a continuation of application Ser. No. 10/190,388, Jul. 3, 2002, now U.S. Pat. No. 6,865,854

FIELD OF THE INVENTION

The present invention is directed to an improved counter top trim molding.

BACKGROUND OF THE INVENTION

Over the past several decades, the general construction of kitchen cabinets has remained generally consistent, with little variation in the underlying structure. Most countertops are essentially horizontal rectangular sections of wood covered with a laminate. On many counter tops, a vertical section known as a back splash is inserted between the counter top and the wall. The vertical back splash section is typically covered with a similar laminate.

The primary focus of technological developments in counter top cove molding construction has been on improving the appearance of the counter top, while sealing and joints in the counter top to keep out water. The laminate that covers the countertop is generally a colored polymer sheeting material that is glued to the house. Laminate is extremely durable and long-lasting and is well known to the art and is not covered in detail in this invention. Laminate is usually colored to match the decor of the kitchen or bathroom were the counter tips is located. However, on most modem countertops, the joint between the counter top and the wall, or alternatively the counter top and the back splash is a simple corner, forming a 90° angle between the counter top and the wall, or the counter top and the back splash. Such a joint is unattractive and can be difficult to clean. Solving this problem has been approached in a number of different ways, including the use of extruded deformable PVC moldings and metal cove molding inserts, which can be placed over the joint between the countertop and the wall.

All of the prior art has one key drawback, namely the limited number of color selections available. In the case of the metal cove molding inserts, the only available color is chrome. In the case of the deformable PVC moldings, colored PVC can be created, however, the color of the PVC does generally not exactly match the large number of colors and styles of the laminate. This type of molding also has the disadvantage of being limited to a solid color, the color that is mixed into the PVC prior to extrusion, which is not compatible with a large number of laminate color schemes, namely any laminates that are patterns. In addition as deformable PVC is impacted during normal wear and tear, it does not maintain the high quality appearance of laminate.

Prior art does exist that allows a continuous sheet of laminate to be applied over a countertop and the associated back splash with a metal substrate supporting the cove molding. However, due to the large size and awkward shape of an assembled countertop unit, assembly of the counter top and backsplash prior to installation in a kitchen or bathroom is cost prohibitive. In addition, such a pre-assembled system is not useful for counter tops that have already been installed or counter tops that do not have a back splash. No prior art exists that allows exact color and style coordination between a cove molding and the laminated countertop.

What is required is a separate laminated cove molding that is inexpensive, attractive, and water tight.

SUMMARY OF THE INVENTION

The present invention has been developed to overcome the shortcomings of prior art cove moldings. The invention relates to cove molding as used in the cabinet art, and in particular to the art of molding for kitchen cabinets, although it has application for kitchen and bathroom splash boards.

The present invention provides a cove molding that is a non-deformable substrate, such as wood, metal, or polymer. The cove molding has a rectangular elongated strip section that fits between the counter top and the wall or between the counter top and the back splash, and a laminated triangular section that is specifically designed to coordinate colors and patterns with new or pre-installed laminated counter tops. The cove molding may be used with a counter top with or without a back splash. If the cove molding is used with a counter top having a back splash, the cove molding is installed between the counter top and the back splash. If the cove molding is used with a counter top that does not have a back splash, the cove molding is installed between the counter top and the wall.

The laminate on the subject cove molding may be of any color or style, which allows the color of the laminate on the subject cove molding to either match the color of the laminate on the counter top or to provide an accent color to the color of the laminate or other material on the counter top. The laminate may also be otherwise related to the laminate or other material on the counter top. The subject cove molding may be installed at the time the counter top is installed or after the counter top has been installed. The subject cove molding may be attached to the counter top with a physical fastener such as a nail or screw, or may simply be set into place without any mechanical fastening devices using a sealant or adhesive.

In order to install the subject cove molding, a sealant must be applied between the counter top and the cove molding in order to prevent water from penetrating the counter top or the cove molding or joint therebetween. The sealant may be applied between the counter top and the wall prior to installing the cove molding in order to hold the cove molding in place. If the seal between the cove molding and the counter top is not watertight, water could penetrate the wood portion of the countertop and/or the cove molding (if the molding is constructed of wood) and cause the counter top and/or cove molding to rot and decay over time.

The physical properties of expanded PVC are particularly suited to use with counter tops as cove molding pieces, particularly when compared to prior art cove moldings that are composed primarily of regular extruded PVC. Expanded PVC is much more rigid than regular extruded PVC and lends itself well to being machined into cove moldings that have essentially planar sections as in the present invention. In addition expanded PVC is much more resistant to deformation due to compression than is regular extruded PVC.

The present invention may be made from wood, metal, or a polymer, such as standard expanded polyvinyl chloride. Prior art cove molding uses standard deformable extruded PCV. However, standard extruded PVC is too deformable to allow the application of laminate using strong adhesive, such as contact adhesive. If contact adhesive is used, in order to attach laminate to PVC, high pressure must be applied to the contact adhesive to create a strong bond between the laminate and PVC (or other cove molding substrate). Normal extruded PVC permanently deforms upon application of high pressure required to attach laminate to PVC. The unique physical properties of expanded PVC are well suited to use as the base material for laminate in the present invention. As PVC is aerated during its manufacture it expands and provides an essentially hard foam that is inherently resistant to deformation under high pressure. Since expanded PVC is much less flexible than normal PVC, expanded PVC is more easily machined than extruded PVC, which does deform, as expanded PVC does not readily deform when cut or planed. Normal extruded PVC is not well suited to being machined, as it is a deformable amorphous polymer.

As an added aid in installation in the case of counter tops with associated back splashes, the rectangular strip portion of the cove molding may be machined into preselected widths so as to fit without cutting to the preselected backsplash board generally used in such installations. However, the rectangular strip portion of the cove molding may be machined into narrower or wider widths, so that the molding can fit the entire width of the respective back splash.

In one method of manufacture of the cove molding, the laminate is first applied to a substrate using an appropriate adhesive. The laminated substrate is then cut to size. The laminated substrate is then attached to a second thin rectangular sheet substrate using an appropriate adhesive. The laminated substrate is then planed down the side of the cove molding that abuts the wall. This planing removes both excess substrate and laminate from the cove molding. The molding is then machined on the side that will ultimately face the countertop, to remove a portion of the substrate to create an edge of the triangular section of the substrate that is essentially a lip of cove molding that is sealed to the surface of the counter top.

Other features and advantages of the present invention will be apparent from the following more detailed description of the preferred embodiment, taken in conjunction with the accompanying drawings which illustrate, by way of example, the principles of the invention.

One advantage of the present invention is the ability to accent, match, or relate the color of the laminate on the cove molding with the laminate on the counter top.

Another advantage of the present invention uses inexpensive materials in its manufacture.

Another advantage of the present invention is that the cove molding is relatively easy to repair or replace as necessary.

DETAILED DESCRIPTION OF THE INVENTION

The purpose of the laminated cove molding member is for insertion between a counter top having a substantially horizontally extending surface and a vertical wall. Alternatively, the cove, molding may also be inserted between a counter top having a substantially horizontally extending surface and a back splash having a substantially vertically extending surface.

The cove molding member comprises a rectangular elongated strip section further comprising non-deformable material, with the rectangular elongated strip section having a first substantially planar surface and a second substantially planar surface, with the elongated strip section being sized to substantially approximate the width of the side of the counter top that is designed to abut the wall, joined to a triangular strip section.

The triangular strip section forming an end of the elongated strip section further comprising non-deformable material having a third and fourth planar surface, with the third planar surface being at a first preselected acute angle to the first and second planar surfaces, and with the fourth planar surface being substantially perpendicular to the first and second planar surfaces and being at a second preselected acute angle to the third planar surface.

The cove molding member also has a laminate material affixed to a portion of the triangular section and affixed to the triangular section planar surface forming a laminated triangular section, with the laminate material being wear resistant and impervious to water.

Alternatively, the cove molding member may comprise the laminated triangular section without the rectangular elongated strip section.

Figure 1:
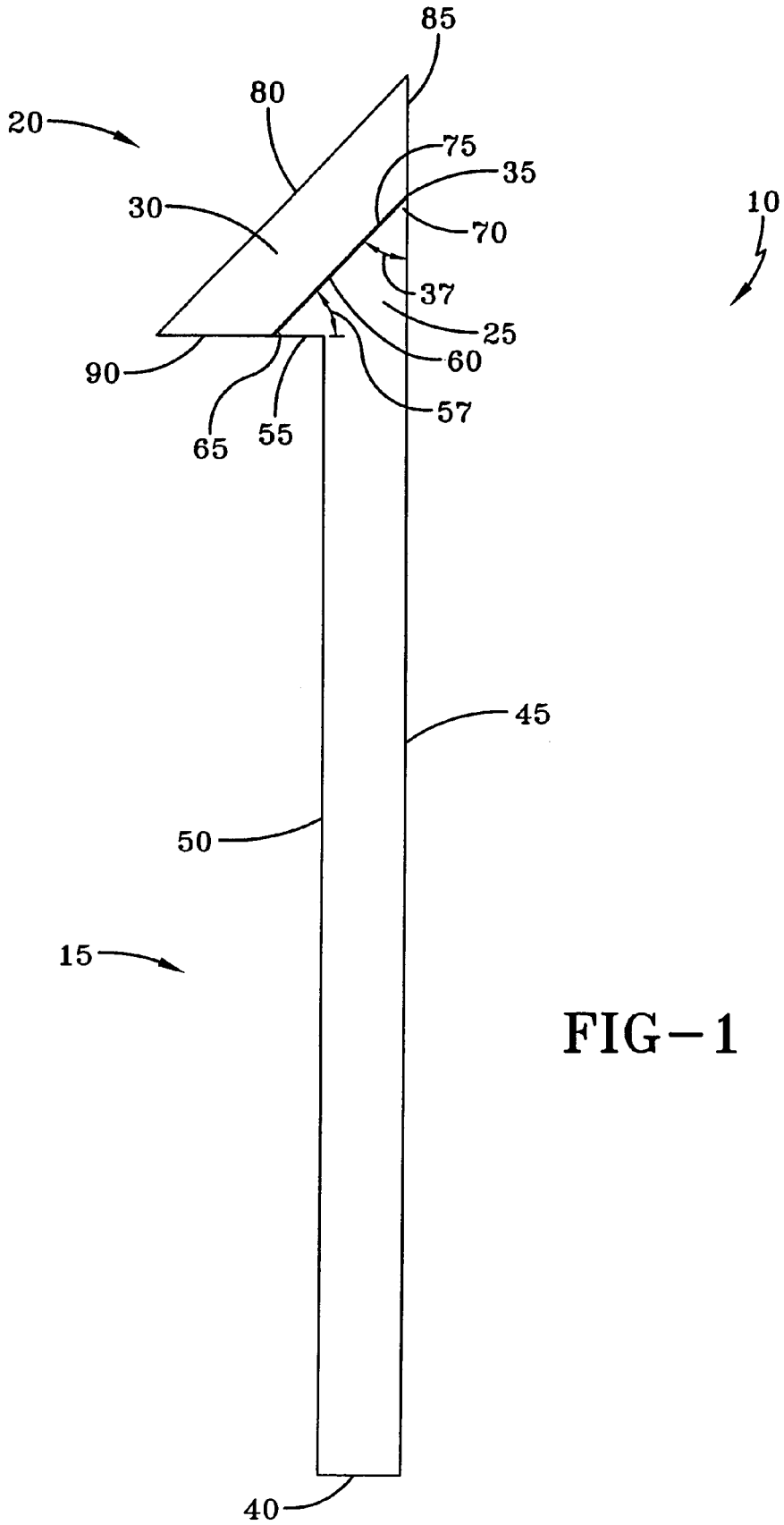
FIG. 1 is a cross-sectional view of a preferred embodiment of the invention, prior to installation.

Referring now to FIG. 1 there is shown a preferred embodiment of the cove molding device 10 having a rectangular elongated strip section 15 with a triangular end section 20. The entire elongated strip section 15 comprises of a preselected non-deformable substrate material, while only a portion 25 of the triangular end section 20 of the cove molding device comprises the substrate material. In a preferred embodiment, the preselected substrate is selected from the group consisting of wood, aluminum, stainless steel and polymers. In a more preferred embodiment, the substrate is expanded polyvinyl chloride (PVC). A portion of the triangular section is trapezoidal elongated laminate 30 that is both wear resistant and impervious to water. Laminate is generally a polymer or composite material and is well known to the art. Laminate can have any number of different colors and/or patterns associated with it. A thin layer of adhesive 35 secures the laminate 30 to the substrate. In a preferred embodiment, the adhesive is contact adhesive. A first side of the substrate portion of the cove molding 45 is longer than a second, opposed side of the substrate portion 50. The end of the elongated strip portion 40 opposite the triangular end section 20 may be of any geometric shape, with the preferred embodiment forming a plane substantially perpendicular to the two opposed sides of the substrate portion 45 and 50. The second side 45 of the substrate portion forms at least a portion of one of the sides of the triangular section 20. The first or shorter side 50 of the substrate intersects the triangular section 20 forming a right angle. One edge 55 of the substrate portion 25 of the triangular section 20 extends at a right angle from the shorter side 50. The end face 60 of the substrate portion 25 forms a surface that extends across the substrate portion from a first end 65 of the edge 55 to a second end 70 of the end face 55. The end face 60 forms at a preselected first acute angle 57 with respect to edge 55. In a preferred embodiment of this invention the first acute angle 57 is in the range of about 15° to about 75°. In a more preferred embodiment the first acute angle 57 is about 45°. A second acute angle 37 is also formed between the end face 60 and the second side 45. In a preferred embodiment of this invention, the second acute angle 37 is in the range of about 15° to about 75°, with the further limitation that the first and second acute angles are complimentary, that is, the sum of second acute angle 37 and first acute angle 57 is 90°. The elongated laminate has a shorter side 75, a longer side 80, a first edge 85 and a second edge 90. The shorter side of the elongated laminate 75 defines a plane that is attached to the end face of the strip 60 with the thin layer of contact adhesive 35. The first edge of the laminate 85 is coplanar with the long side of the substrate portion 45. The second edge of the laminate 90 is coplanar with the edge 55 of the substrate portion of the triangular section that is substantially perpendicular to the first side and a second side.

In a preferred embodiment, the cove molding has a preselected height inclusive of the length of both the long side of the substrate 45 and the edge of the laminate 85. The length of the cove molding, extending perpendicular to FIG. 1, will necessarily vary depending on the length of the counter top. In a more preferred embodiment, the cove molding height measures about ½ inch to about 4 inches in height inclusive of the length both the long side of the substrate 45 and the edge of the laminate 85. In a more preferred embodiment, the cove molding height measures about 1 19/32 inches in height inclusive of the length both the long side of the substrate 45 and the edge of the laminate 85. In a preferred embodiment, the thickness of the elongated rectangular section from the long side of the substrate 45 to the short side of the substrate 50 is a preselected essentially uniform thickness. In a preferred embodiment, the thickness of the elongated rectangular section from the long side of the substrate 45 to the short side of the substrate 50 is in the range of about 1/32 inch to about ½ inch. In a preferred embodiment, the thickness of the elongated rectangular section from the long side of the substrate 45 to the short side of the substrate 50 is about 3/32 inch. The longer side of the laminate 80 is a preselected length. In a preferred embodiment the longer side of the laminate 80 is in the range of about ¼ inch to about 1 inch. In a more preferred embodiment, the longer side of the laminate 80 is about 13/32 inch wide.

Figure 2:
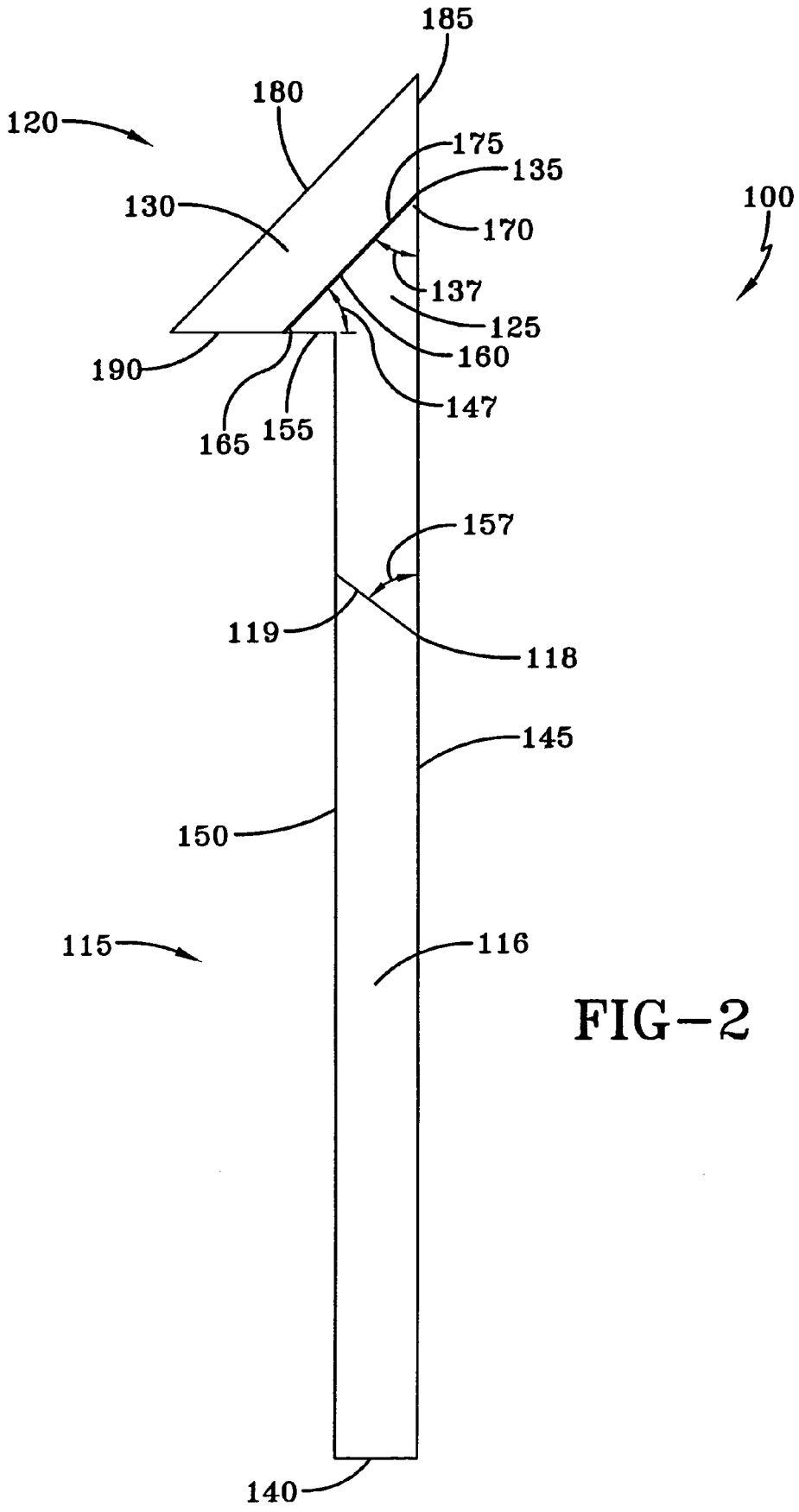
FIG. 2 is a cross-sectional view of a preferred embodiment of the invention, prior to installation.

Referring now to FIG. 2 there is shown a second preferred embodiment of the cove molding device 100 having a rectangular elongated strip section 115 and a triangular end section 120. The elongated strip section 115 and end section 120 are comprised of a preselected substrate. In a preferred embodiment, the preselected substrate is selected from the group consisting of wood, aluminum, stainless steel, polymers, and combinations thereof. Although it is preferred to have the substrate made from a single material, strip section 115 and end section 120 may be composed of different materials. In a more preferred embodiment, the substrate is expanded PVC. Affixed to triangular end section 120 is a laminate 130 that is trapezoidal in cross-section extending lengthwise in a plane perpendicular to FIG. 2. A thin layer of adhesive 135 secures the laminate 130 to the substrate. In a preferred embodiment, the adhesive 135 is contact adhesive. The substrate is comprised of two pieces, a first piece 116 that comprises a first portion of the elongated strip section, and a second piece 117 that comprises a second portion of the elongated strip section 115 and integral triangular section 120. The two pieces of substrate are joined together with a layer of adhesive 118. In a preferred embodiment, this adhesive 118 is polyacetate. A first side 145 of the substrate portion of the cove molding device 100 is longer than a second, opposed side of the substrate portion 150. The joint between the two pieces of substrate 119 is planar, forming a preselected acute angle 157 with respect to the first side of the second piece 117. In a preferred embodiment the acute angle 157 in a range of about 15° to about 75°. In a more preferred embodiment the acute angle 157 is about 45°. However, the joint may assume any other convenient shape such as a dovetail joint, a tongue and groove joint, or a ball joint. Alternatively, the substrate may consist of more than two pieces of substrate material joined together in a similar manner. The end of the elongated strip portion 140 opposite triangular end section 120 may be of any shape, with the preferred embodiment forming a plane substantially perpendicular to the two opposed sides of the expanded PVC portion 145 and 150. The longer side of the substrate portion 145 forms at least a portion of one of the sides of the triangular section 120. The shorter side of the substrate 150 intersects a leg of triangular section 120 at a right angle. One edge 155 of the substrate portion 125 of the triangular section 120 extends substantially perpendicular from the shorter side of the substrate portion 150. The end face 160 of the substrate portion 125 forms a surface that extends from a first end 165 of edge 155 to the end 170 of edge 155 of the long side of the substrate portion 145. The end face 160 forms a preselected first acute angle 147 with respect to edge 155. In a preferred embodiment of this invention the first acute angle 147 is in the range of about 15° to about 75°. In a more preferred embodiment the first acute angle 147 is about 45°. A second acute angle 137 is also formed between the end face 160 and the longer side 145. In a preferred embodiment of this invention, the second acute angle 137 is in the range of about 15° to about 75°. The first and second angles are complementary, that is, the sum of second acute angle 137 and first acute angle 147 is about 90°. The elongated laminate has a shorter side 175, a longer side 180, a first edge 185 and a second edge 190. The shorter side of the elongated laminate 175 defines a plane and is attached to the end face of the strip 160 with the thin layer of contact adhesive 135. The first edge of the laminate 185 extends in a plane from the long side of the substrate portion 145. The second edge of the laminate 190 is coplanar with the edge 155 of the PVC portion of the triangular section that is substantially perpendicular to the first side 145 and second side 150.

Figure 3:
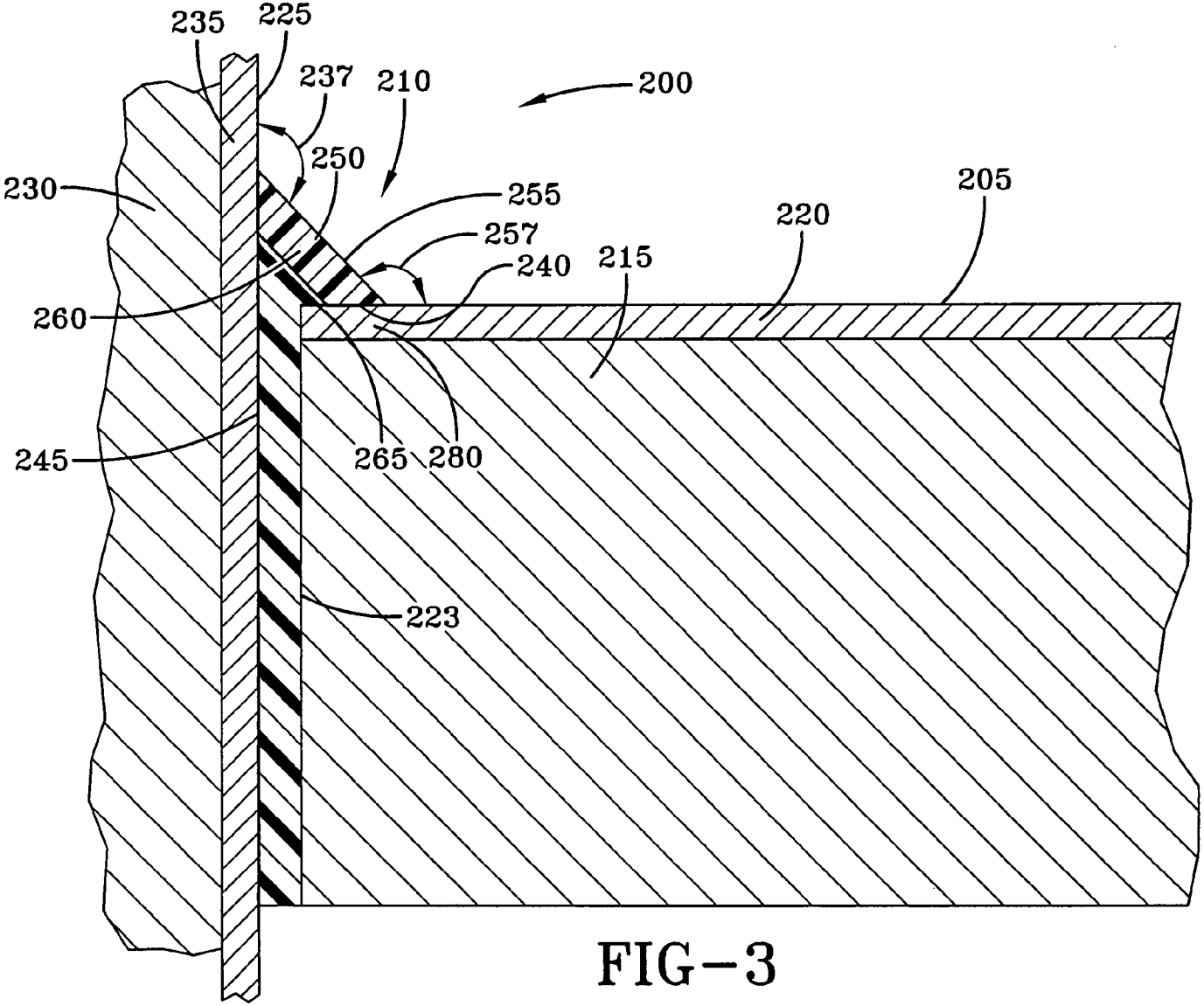
FIG. 3 is a cross-sectional view of the invention, shown installed.

Referring now to FIG. 3, there is shown a cross-section of an exemplary countertop structure 200 having a substantially horizontal planar top deck 205, hereinafter called the counter top surface, and an installed cove molding 210. The counter top 215 is faced by any conventional sheet material 220, such as laminate, ornamental tile or other composition material, which is extensively used with counter tops. The rear and/or side vertical edges of the countertop 215 are substantially flush against the vertical inner surface 223 of the cove molding 210. The surface 225 of the wall is generally backed by a base structure of plaster, wallboard or the like 230 and faced with a covering of some continuous sheet material such as laminate, paint, or layer of ornamental tile 235. The cove molding 210 may be secured to the countertop by a layer of substantially waterproof sealant 240 between the cove molding and the counter top and a layer of sealant between the cove molding and the wall 245. The layers of sealant 240 and 245 must be sufficiently continuous to prevent water or other liquids from penetrating under the cove molding where the cove molding meets the counter top surface 205. The sealant must be present between the counter top and the cove molding. In a preferred embodiment, the layers of sealant 240 and 245 are silicon. Alternatively, the cove molding may be secured to the counter top with at least one mechanical fastener (not shown) as known to the art. In a preferred embodiment, the laminate portion of the cove molding 250 is identical in color and texture to the sheet material 220. In an alternative embodiment, the color and texture of the laminate portion of the cove molding 250 is related to the color and texture of the sheet material 220 such that the color and the texture of the laminate portion and the sheet material blend and/or do not clash. As installed, only the long side of the cove molding laminate 255 is visible on the counter top, the remainder of the cove molding being hidden from view. The lower edge 265 of the triangular section 260 of the cove molding acts as a lip that covers a small section of a portion of the sheet material nearest to the wall 280. The angle between the sheet material 235 and the long side of the cove molding laminate 255 transcribes a preselected obtuse angle 237. In a preferred embodiment, the preselected obtuse angle 237 is in the range of about 105° to about 165°. In a more preferred embodiment, the preselected obtuse angle is about 135°. The angle between the sheet material surface of the counter top surface 205 and the long side of the cove molding laminate 255 transcribes a preselected obtuse angle 257. In a preferred embodiment, the preselected obtuse angle 257 is in the range of about 105° to about 165°. In a more preferred embodiment the preselected obtuse angle 257 is about 135°.

In an alternative embodiment, the cove molding may be installed between the counter top and a back splash. In such a case, the cove molding would be placed between the counter top and the back splash, instead of against a wall and all of the previously mentioned features that addressed the wall should be considered to be equally applicable to a back splash member. The major difference between the two embodiments is that the cove member is essentially horizontal when installed with a back splash member, while the cove member is essentially vertical when installed against a wall.

Figure 4:
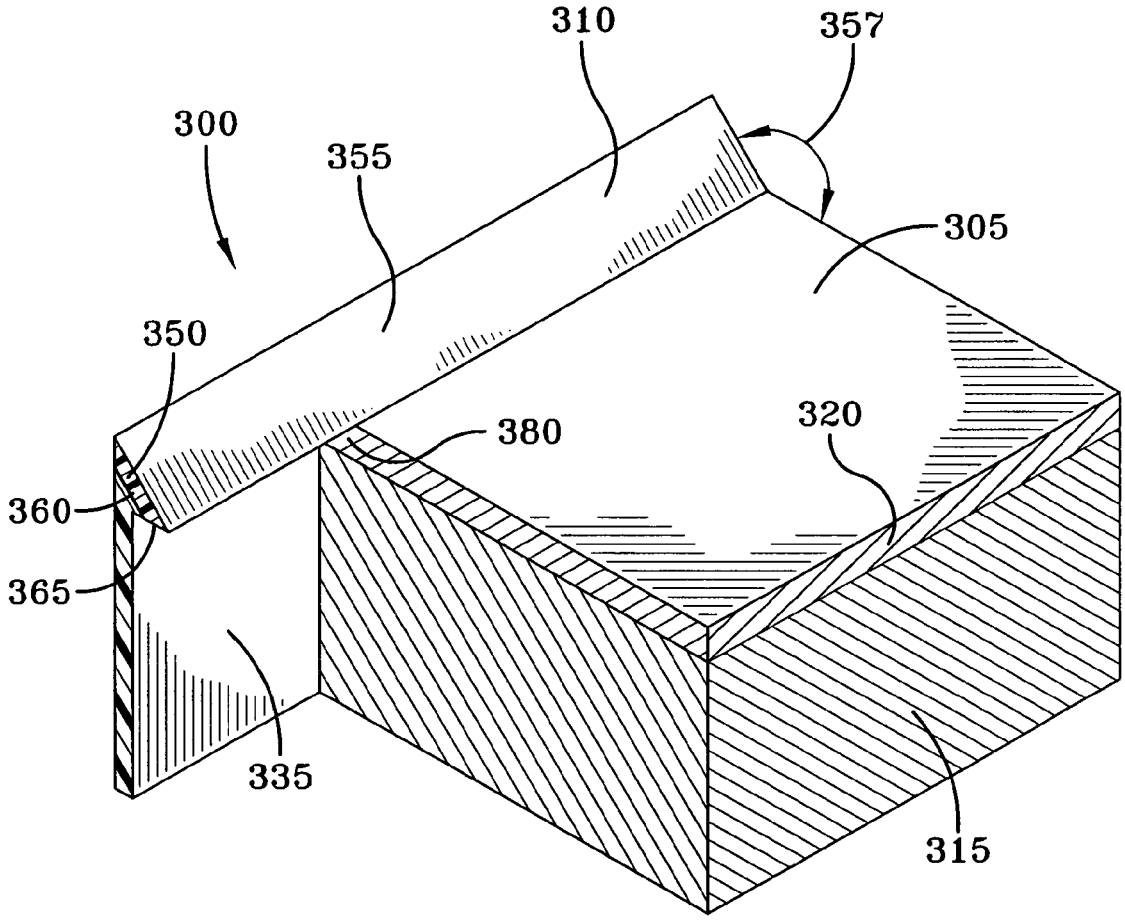
FIG. 4 is a partial section view of the invention, shown installed.

Referring now to FIG. 4 there is shown there is shown exemplary countertop structure 300 in a perspective and partial section view showing the installed cove molding having a counter top 315 and an installed cove molding 310. In FIG. 4, the wall is not shown. The counter top 315 is surfaced by any conventional sheet material 320, such as laminate, ornamental tile or other composition material, which is extensively used with counter tops. The rear and/or side vertical edges of the countertop 315 are substantially flush against the vertical inner surface 355 of the cove molding 310. In a preferred embodiment, the laminate portion of the cove molding 350 is identical in color and texture to the sheet material 320. In an alternative embodiment, the color and texture of the laminate portion of the cove molding 350 is related to the color and texture of the sheet material 320 such that the color and the texture of the laminate portion and the sheet material blend and/or do not clash. As installed, only the long side of the cove molding laminate 355 is visible on the counter top, the remainder of the cove molding being hidden from view. The lower edge 365 of the triangular section 360 of the cove molding acts as a lip that covers a small section of a portion of the sheet material nearest to the wall 380. The angle between the sheet material surface of the counter top surface 305 and the long side of the cove molding laminate 355 transcribes a preselected obtuse angle 357. In a preferred embodiment, the preselected obtuse angle 357 is in the range of about 105° to about 165°. In a more preferred embodiment the preselected obtuse angle 357 is about 135°.

Figure 5:
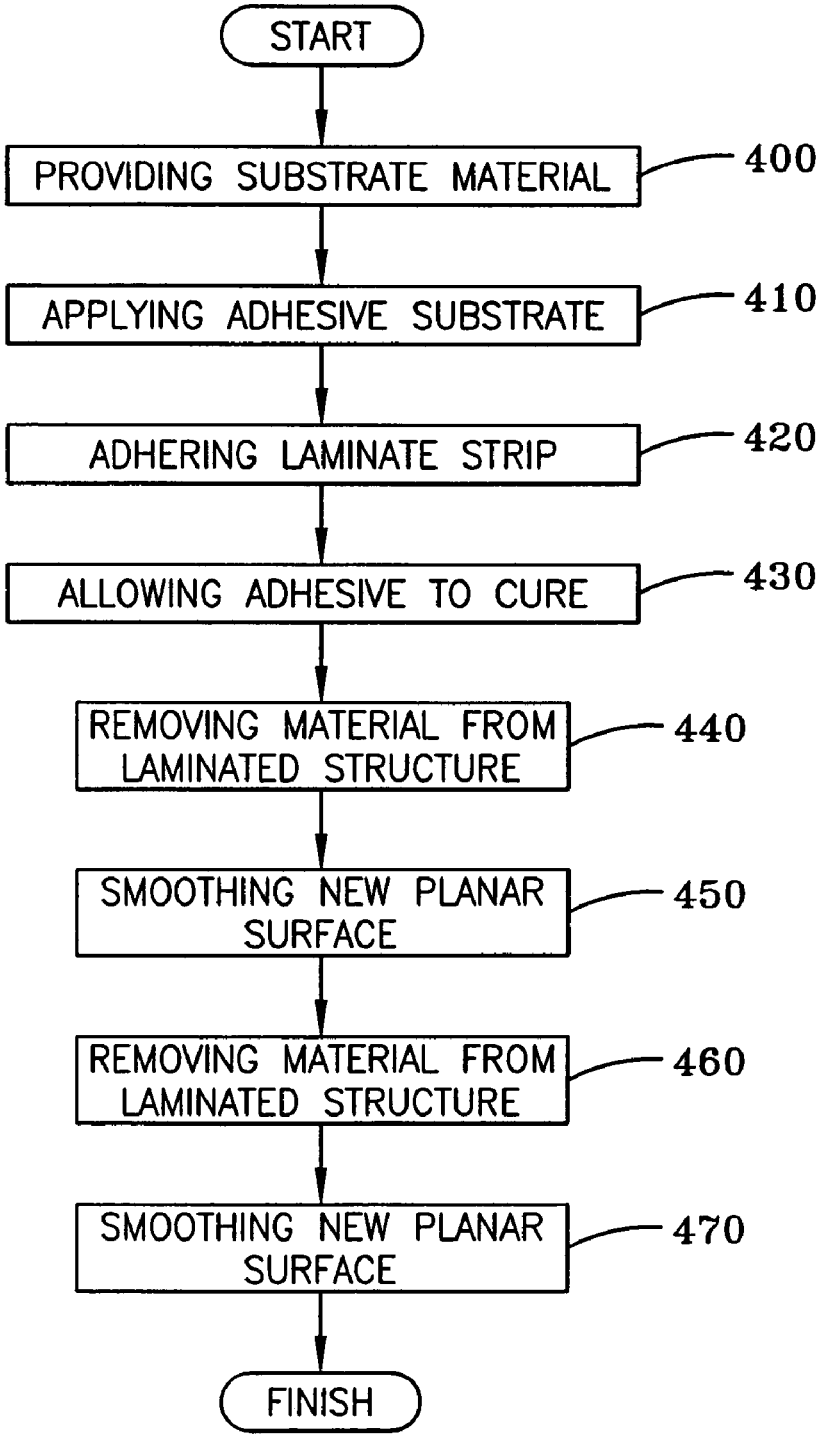
FIG. 5 is a flow chart showing a preferred method of manufacture of the invention.

Referring now to FIG. 5, there is shown a flow chart that illustrates a preferred method of manufacturing the cove molding of the present cove molding invention. First, a rectangular sheet of substrate material is provided having a preselected length, a preselected width, a first preselected thickness, a first planar face, and an opposed second planar face 400. Second, an adhesive is applied to the first planar face of the rectangular sheet 410. Next, a laminate strip is adhered on the first planar face of the rectangular sheet, with the laminate strip selected so as to be wear resistant and impervious to water 420. The laminated structure is formed by allowing the adhesive to cure after the laminate strip is adhered 430. A portion of the laminated structure is now removed to create a third planar surface intersecting the laminate strip at a preselected acute angle to the first planar face 440. The third planar surface is smoothed to provide a flat surface having a preselected surface finish 450. A portion of the laminated structure is then removed from the first planar face and opposite the third planar face to form a fourth planar face substantially parallel to the third planar face, the distance between the third planar face and the fourth planar face being a preselected thickness and to form a fifth planar surface substantially perpendicular to the fourth planar surface, the fifth planar surface forming a second preselected acute angle with the first planar surface 460. Next, the surface of the fifth planar surface is planed to provide a flat surface having a preselected surface finish 470. The preselected surface finish is sufficiently smooth to fit cleanly against the surface of a counter top, a wall, and/or a back splash. The preselected surface finish is sufficiently rough to readily allow an adhesive to bond to bind the cove molding to other preselected surfaces, such as walls, tile, wood, laminate, and other composite materials. In a preferred embodiment, he first preselected acute angle is in the range of about 15° to about 75° and the second preselected acute angle is in the range of about 15° to about 75°, wherein the sum of the first and second acute angles is about 90°. In a more preferred embodiment, the first preselected acute angle is about 45° and the second preselected acute angle is about 45°.

Alternatively, the cove molding member may be manufactured using an extrusion process. For such an extrusion process, an extrusion die having a preselected size and a predetermined cross-section defined by at least four contiguous lines, wherein a first line intersects a second line at a first preselected acute angle, wherein a third line intersects the first line at a second preselected acute angle, wherein a fourth line intersects the third line at about a right angle, and wherein the second and fourth lines are substantially parallel to one another and separated by a preselected distance that forms a preselected thickness is provided. The extrusion die may have a fifth contiguous line in the its cross section, however, the presence or geometry of such a line is not critical to the manufacturing process. In a preferred embodiment, a fifth contiguous line is present in the cross-section of the die that is substantially perpendicular to and intersects the second and third lines. A substrate material is provided having a preselected length and a preselected cross-sectional area to allow it to cover the extrusion dye of a preselected size. The substrate material is extruded the substrate material through the extrusion dye, with the extruded substrate material has the cross-section of the die. A strip of laminate material is provided, wherein said laminate material is wear resistant and impervious to water. The laminate is affixed to a planar face of the substrate material. In a preferred embodiment, the first preselected acute angle is in the range of about 15° to about 75° and the second preselected acute angle is in the range of about 15° to about 75°, wherein the sum of the first and second acute angles is about 90°. In a more preferred embodiment, the first preselected acute angle is about 45° and the second preselected acute angle is about 45°. Although described as a single step extrusion process, the process may be carried out by a plurality of dies in a plurality of operations that produce the final cross-section.

Alternatively, the cove molding member may be manufactured using an injection molding process. For such a process, an injection mold having a preselected size is provided, said injection mold having an inner and an outer surface, said inner surface having a predetermined cross-section defined by at least four contiguous lines, where a first line intersects a second line at a preselected acute angle, where a third line intersects the first line at a preselected acute angle, where a fourth line is at a substantially right angle to the third line, and where the second and fourth lines are substantially parallel to one another and separated by a preselected distance that forms a preselected thickness is provided. An injection moldable substrate material to form a cove molding is also provided. The material is injected into the injection mold and allowed to cure. The cured cove molding is then removed from the injection mold after it is cured. A strip of laminate material is also provided where the laminate material is wear resistant and impervious to water. The laminate is adhered to the first planar face of the cove molding to form a laminated cove molding. In a preferred embodiment, the first preselected acute angle is in the range of about 15° to about 75° and the second preselected acute angle is in the range of about 15° to about 75°. In a more preferred embodiment, the first preselected acute angle is about 45° and the second preselected acute angle is about 45°. The laminate may be adhered to the cove molding subsequent to the curing of the injection molded material. Alternatively, the laminate can be placed in the die and the injection molded material can be cured directly to the laminate as part of the injection molding process. Subsequent finishing operations can be performed on the cove molding after curing, if required.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A laminated cove molding member for installation on a counter top having a substantially horizontally extending surface and a vertical wall, said molding member comprising:

a triangular strip section having a first, second, and third planar surfaces, said third planar surface being at a first preselected acute angle to the first planar surface and the second planar surface being at a substantially right angle to the first planar surface, said triangular strip section being sized to substantially approximate the width of the counter top;

a laminate material affixed to the third planar surface forming a laminated triangular section, said laminate material being wear resistant and impervious to water.

2. The laminated cove molding member of claim 1, wherein the triangular strip section is comprised of a non-deformable material.

3. The laminated cove molding member of claim 2, wherein the non-deformable material is selected from the group consisting of wood, aluminum, stainless steel, expanded polyvinyl chloride, and combinations thereof.

4. The laminated cove molding member of claim 3, wherein the triangular strip section comprises expanded polyvinyl chloride.

5. The laminated cove molding member of claim 4 wherein the laminate material is joined to the triangular strip section with adhesive.

6. The laminated cove molding member of claim 5, wherein the adhesive is contact adhesive.

7. The laminated cove molding member of claim 5, wherein the first preselected acute angle is in the range of about 15° to about 75°.

8. The laminated cove molding member of claim 2, wherein the laminate material is joined to the triangular section with adhesive.

9. The laminated cove molding member of claim 8, wherein the adhesive is contact adhesive.

10. The laminated cove molding member of claim 9, wherein the first preselected acute angle is in the range of about 15° to about 75°.

11. The laminated cove molding member of claim 10, wherein the first preselected acute angle is about 45°.

12. The laminated cove molding member of claim 2, wherein the first preselected acute angle is in the range of about 15° to about 75°.

13. The laminated cove molding member of claim 12, wherein the first preselected angle is about 45°.

14. A laminated cove molding member for installation on a counter top having a substantially horizontally extending surface and a vertical wall, said molding member comprising:

a triangular strip section having a first, second, and third planar surfaces, said third planar surface being at a first preselected acute angle to the first planar surface and the second planar surface being at substantially a right angle to the first planar surface, said triangular strip section being sized to substantially approximate the width of the counter top; a laminate material affixed to the third planar surface forming a laminated triangular section, said laminate material being wear resistant and impervious to water, the laminate material being joined to the to the triangular strip with adhesive, and wherein the first preselected acute angle is in the range of about 15° to about 75°.

15. The laminated cove molding member of claim molding member of claim 14, wherein the adhesive is contact adhesive.

16. The laminated cove molding member of claim 14, wherein the first preselected angle is about 45°.

17. The laminated cove molding member of claim 15, wherein the first preselected angle is about 45°.

18. A laminated cove molding member for installation on a counter top having a substantially horizontally extending surface and a vertical wall, said molding member comprising:

a triangular strip section having a first, second, and third planar surfaces, said third planar surface being at a first preselected acute angle to the first planar surface and the second planar surface being at substantially a right angle to the first planar surface, said triangular strip section being sized to substantially approximate the width of the counter top;

a laminate material affixed to the third planar surface forming a laminated triangular section, said laminate material being wear resistant and impervious to water, the laminate material being joined to the to the triangular strip with contact adhesive, and wherein the first preselected acute angle is about 45°.

* * * * *

UNITED STATES PATENT AND TRADEMARK OFFICE

CERTIFICATE OF CORRECTION

PATENT NO. : 7,010,892 B2
DATED : March 14, 2006
INVENTOR(S) : Jason Tonkin

It is certified that error appears in the above-identified patent and that said Letters Patent is hereby corrected as shown below:

Column 7,
Line 43, "surface 355 of the cove" should be -- surface 335 of the cove --.

Column 10,
Line 38, "to the to the" should be -- to the --.
Lines 41-42, "member of claim molding member of claim 14" should be -- member of claim 14 --.
Line 63, "to the to the" should be -- to the --.

Signed and Sealed this

Sixth Day of June, 2006

JON W. DUDAS
*Director of the United States Patent and Trademark Office*